US005417991A

United States Patent [19]

Green

[11] Patent Number: 5,417,991

[45] Date of Patent: May 23, 1995

[54] MICROWAVE HEATING OF CHEESE SAUCES

[75] Inventor: Bobby E. Green, Chicago, Ill.

[73] Assignee: Kraft General Foods, Inc., Northfield, Ill.

[21] Appl. No.: 268,733

[22] Filed: Jun. 30, 1994

Related U.S. Application Data

[60] Continuation of Ser. No. 178,908, Jan. 7, 1994, abandoned, which is a division of Ser. No. 877,870, May 4, 1992, abandoned.

[51] Int. Cl.[6] ..... A23C 19/00; H05B 6/00

[52] U.S. Cl. ..... 426/241; 219/734; 426/107; 426/234; 426/589

[58] Field of Search ..... 426/241, 243, 107, 234, 426/589; 219/725, 734; 215/1 C

[56] References Cited

U.S. PATENT DOCUMENTS

| | | | |
|---|---|---|---|
| D. 190,770 | 6/1961 | Gould | D58/8 |
| D. 239,368 | 3/1976 | McDonald | D9/143 |
| D. 346,964 | 5/1994 | Green | D9/574 |
| 4,490,597 | 12/1984 | Mengel | 219/10.55 E |
| 4,568,555 | 2/1986 | Spanier | 426/589 |
| 4,613,738 | 9/1986 | Saville | 219/10.55 R |
| 4,661,672 | 4/1987 | Nakanaga | 426/243 |
| 4,933,529 | 6/1990 | Saville | 219/10.55 R |
| 4,969,587 | 11/1990 | Miller | 224/148 |
| 4,983,798 | 1/1991 | Eckler et al. | 219/10.55 M |
| 5,101,990 | 4/1992 | Krishnakumar et al. | 215/1 C |
| 5,158,817 | 10/1992 | Krishnakumar | 215/1 C |

FOREIGN PATENT DOCUMENTS

| | | |
|---|---|---|
| 2057588 | 2/1990 | European Pat. Off. . |
| 0383516A3 | 8/1990 | European Pat. Off. . |
| 2009050 | 1/1970 | France . |
| 2532621 | 3/1984 | France . |
| 854879 | 11/1960 | United Kingdom . |

OTHER PUBLICATIONS

D&CL/May 1979, p. 86, News in Packaging, "Henna Shampoo Bottle".

Owens-Brockway Plastic Container Catalog (Jan., 1990) (cover and page PC2).

Kaukauna Micro Melt Container (Sep., 1991) (3 pages of photocopies).

*Primary Examiner*—George Yeung

*Attorney, Agent, or Firm*—Fitch, Even, Tabin & Flannery

[57] ABSTRACT

A container for a viscous food product having a configuration which enables relatively uniform heating of the contents at an acceptable rate without scorching in a conventional microwave oven. The preferred container is made from an electrically nonconductive material having a generally ovate bottom wall and a side wall extending upward therefrom to an upper end portion. The side wall may have a substantially ovate cross-section over substantially its entire height. The ovate cross-section may have a width-to-depth ratio of approximately 2:1 over substantially its entire height. The upper end portion may convexly decrease in width proceeding upward on the container.

8 Claims, 1 Drawing Sheet

10
12
14
16
18
20
22
24
26
32
34
36
38a
38b
38c
38d
40
42a
42b
42c
42d
44
46
48
50
52
56
57
59

MICROWAVE HEATING OF CHEESE SAUCES

This application is a continuation of application Ser. No. 08/178,908, filed Jan. 7. 1994, now abandoned, which is a division of application Ser. No. 07/877,870, filed May 4, 1992, now abandoned.

FIELD OF THE INVENTION

The present invention relates generally to containers, and more particularly to a container used to facilitate heating food products contained therein.

BACKGROUND OF THE INVENTION

A disadvantage of some containers intended for microwave heating is that, during exposure to electromagnetic radiation in the oven cavity, certain food products are subject to nonuniform heating wherein hot spots form scorched and hardened areas of food product. It is generally desirable that the container enable substantially uniform heating of the food product for a predetermined length of time in the microwave oven without damaging the food product.

The present invention pertains to a container suitable for microwave heating of cheese sauces and for heating of other viscous liquid food substances as well.

The term "cheese sauce" herein refers to pasteurized process cheese spread, as defined at 21 CFR §§133.169–180, and to other flowable products which contain cheese.

Pasteurized process cheese spread typically contains natural cheese and an emulsifying agent such as a salt, and may contain dairy ingredients such as cream, milk, skim milk, whey, or any of these dairy ingredients from which part of the water has been removed (e.g., concentrated skim milk). Pasteurized process cheese spread may have a moisture level as high as 60%. Other cheese sauces may have higher moisture levels.

Cheese sauces are among the products that have been found to be susceptible to scorching during microwave heating. Where the cheese sauce is intended to be dispensed as a liquid after being heated, such scorching is, of course, entirely unacceptable. This is particularly true where the cheese sauce is packaged in a squeeze bottle for dispensing through a small opening and scorched portions may obstruct flow.

As is known in the art, despite efforts to provide relative uniformity of field intensity in the oven cavity through the use of mode stirrers, field intensity often varies widely as a function of location in the oven cavity. In the past, much effort has been directed toward controlling exposure of the food product to electromagnetic radiation in the oven cavity. Various shields, reflectors, and/or susceptors have been used to enable acceptable temperature gradients to be maintained for certain food products.

However, such devices add to the cost of the package and, in the case of shielding, tend to reduce the rate of heating of the food product, thus increasing the time required to bring the food product to a desired temperature. Such devices generally are useful principally for heating of non-homogeneous food products to enable particular temperature and heat transfer parameters to be maintained.

There is a need for a disposable container for microwave heating of cheese sauce that is suitable for commercial retail sale. In addition to enabling relatively uniform heating of the contents without scorching, the container must satisfy additional requirements, one of which is that the container must not unduly retard heating of the food product. Other considerations include the ability of the container to receive product in filling operations; the ability of the container to withstand various loads during filling, sealing, shipping, display and consumer use; the ability of the container to be packed efficiently among like containers; the appearance of the container, i.e., whether it is sufficiently attractive to be suitable for retail display; biodegradability and/or recyclability; and cost.

A general object of the invention is to provide a container designed to permit uniform heating of a food product such as a viscous cheese sauce at an acceptable rate by exposing the cheese sauce and container to electromagnetic radiation in a microwave oven.

A further object is to provide a lightweight, economical plastic container suitable for packaging of viscous products for retail sale.

SUMMARY OF THE INVENTION

In accordance with the present invention, there is provided a container for a viscous food product, such as a viscous cheese sauce, having a configuration which enables relatively uniform heating of the contents at an acceptable rate, without scorching, in a conventional microwave oven. The preferred container is made from an electrically nonconductive material having a generally ovate bottom wall and a side wall extending upward therefrom to an upper end portion. The side wall may have a substantially ovate cross-section over substantially its entire height. The ovate cross-section may have a width-to-depth ratio of approximately 2:1 over substantially its entire height. More specifically, the container may have a maximum width of about 2.5 in. to 3.5 in., and the sidewall may have a minimum radius of curvature of at least about 0.35 in. as viewed in plan. Proceeding upward, a lower portion of the container may increase in width, and an upper portion gradually decreases in width convexly, i.e., as viewed in front elevation, the upper portions of the sidewalls are outwardly convex. The upper portion may have a minimum radius of curvature of at least about 1 in. as viewed in elevation. The contents of the container are shaped into a mass which has a generally rounded upper end and is ovate in plan, which avoids overradiation of any portions of the contents, and may also facilitate flow in accordance with natural convection.

DETAILED DESCRIPTION OF THE PREFERRED EMBODIMENT

Figures 1, 2, 3, 4, 5, 6, 7:
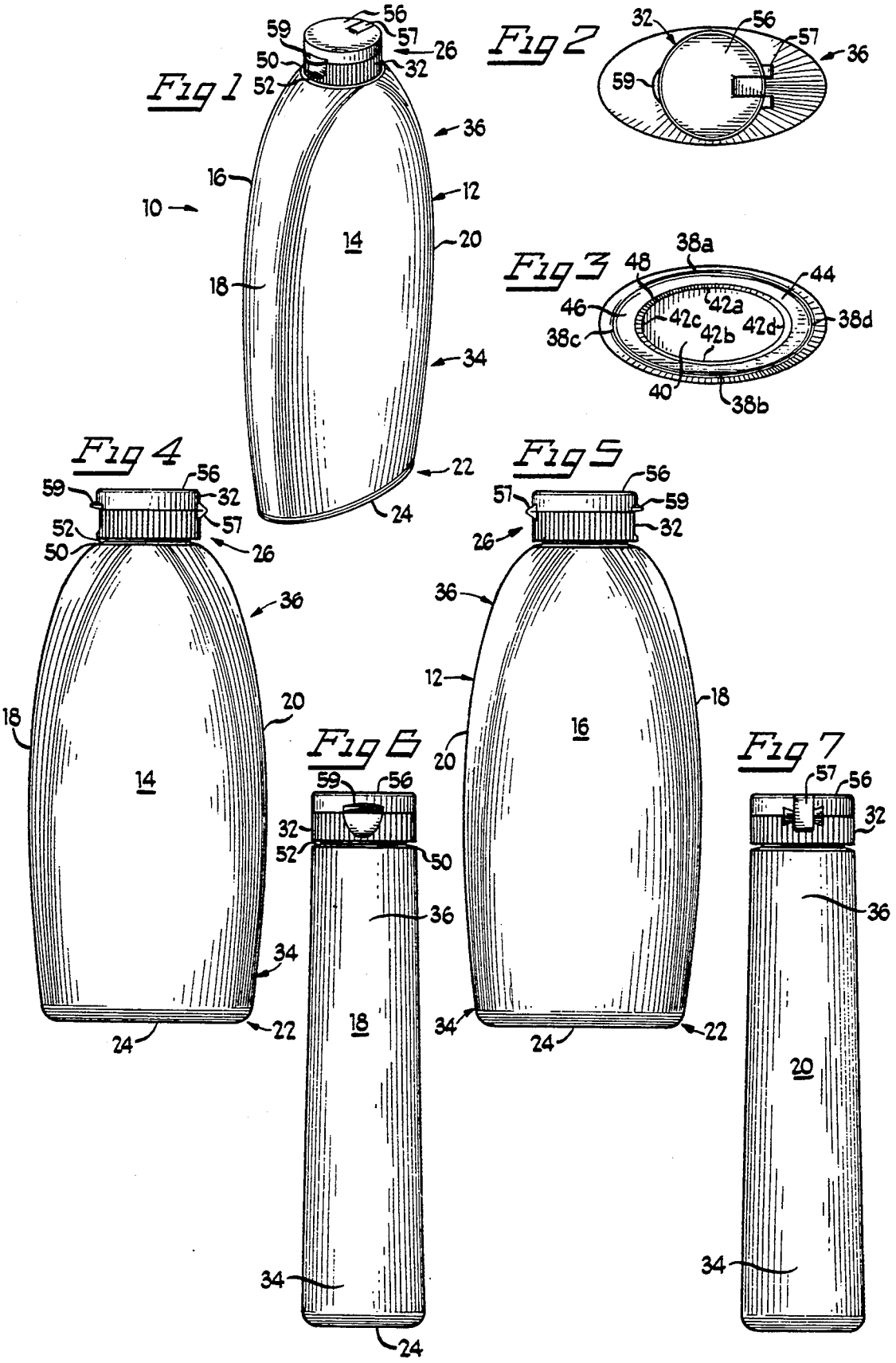
FIG. 1 is a perspective view of a container embodying the invention.
FIG. 2 is a top plan view of the container of FIG. 1.
FIG. 3 is a bottom plan view of the container of FIG. 1.
FIG. 4 is a front elevational view of the container of FIG. 1.
FIG. 5 is a rear elevational view of the container of FIG. 1.
FIG. 6 is a side elevational view taken from the right hand side of FIG. 5.
FIG. 7 is a side elevational view taken from the left hand side of FIG. 5.

As shown in the drawing for purposes of illustration, the invention is preferably embodied in a molded polymeric container 10. In the illustrated embodiment, the container 10 (FIG. 1) includes an upstanding, elongated continuous sidewall 12 with a substantially ovate cross-section. The sidewall 12 is formed generally with arcuate front and back wall sections 14 and 16 and arcuate left and right wall sections 18 and 20 having lesser radius of curvature than the front and back wall sections 14 and 16. The container 10 at its lower end includes a base 22 with a generally horizontal, ovate bottom wall 24, and at its upper end 26, the container 10 includes an upper end having a finish for cooperating with a closure 32 to seal the container 10. The container 10 further includes a lower portion 34 which increases in width proceeding upward from the base 22, and an upper portion 36 which decreases in width proceeding upward to the upper end 26.

In accordance with one feature of the invention, the container 10 is configured to promote relatively uniform heating of a viscous liquid such as a cheese sauce exposed to about 100–1500 Watts of electromagnetic radiation at a frequency of about 0.3 to 300 GHz in a microwave oven to heat the cheese sauce from a first, storage, temperature in a range of about 30° F. to 80° F. to a second, heated, temperature in a range of about 100° F. to 140° F. without damaging the cheese sauce. The container 10 is constructed with an ovate cross-section having a predetermined width-to-depth ratio to maintain a substantially uniform cross-section extending longitudinally throughout the container 10 and with relatively large radii of curvature, as opposed to defined edges in the sidewall and shoulders at the upper end of the container.

Turning to FIG. 3, the bottom wall 24, with its ovate configuration, is defined generally by outer edge segments 38*a*, 38*b*, 38*c* and 38*d* as viewed in plan, with front and rear edge segments 38*a* and 38*b* having a radius of curvature of about 1.75 in. to 2.50 in. and edge segments 38*c* and 38*d* having a radius of curvature about 0.30 in. to 0.45 in. The bottom wall 24 includes a slightly recessed panel 40, with an ovate, generally concave surface, defined by edge segments 42*a*, 42*b*, 42*c* and 42*d*, as viewed in bottom plan, and with each having a radius of curvature less than that of adjacent edge segments 38*a*, 38*b*, 38*c* and 38*d*. A rim 44 extends annularly about the bottom wall between edge segments 38*a*, 38*b*, 38*c* and 38*d* and edge segments 42*a*, 42*b*, 42*c* and 42*d*, as viewed in bottom plan. The rim 44 provides a surface 46 to support the container 10 when standing upright. The base 22 and the bottom wall 24 are sized to provide support during filling operations and to provide stability for standing upon a shelf or the like.

The lower portion 34 of the sidewall 12 intersects the bottom wall 24 and extends upward therefrom at a radius of curvature of about 0.25 in., as viewed in elevation (FIG. 3 and 4). Once the lower portion 34 of the sidewall 12 turns substantially vertical, it increases gradually in width (FIG. 4) and decreases gradually in depth (FIG. 6) proceeding upward on the container 10. The decreasing depth places more of the cheese sauce toward the bottom of the container to provide container stability for filling operations and standing upright on the shelf.

The ovate cross-section is maintained over substantially the entire height of the container 10. The ovate cross-section requires at least a pair of differing radii of curvature for the opposing pairs of arcuate walls. That is, the front and back wall sections 14 and 16 include a radius of curvature of about 2 in. to 3 in., and the left and right wall sections 18 and 20 include a lesser radius of curvature of about 0.35 in. to 0.65 in. The ovate cross-section is in accordance with a primary feature of the invention because it facilitates uniform heating of the cheese sauce. That is, the ovate cross-section provides a smooth interior surface for the container 10 having large radii of curvature.

To further facilitate uniform heating, the upper portion 36 decreases in width and depth gradually as it proceeds upward to the upper end 26, thereby not creating defined shoulder regions, which would present increased risk of scorching and hardening because the exposure to electromagnetic radiation is greater in such regions.

Accordingly, the width (FIG. 4) of the upper portion 36, in order to intersect the upper end 26 without forming defined shoulders, decreases by convexly curving inward with a radius of curvature of about 1 in. to 1.5 in., and the depth (FIG. 6) of the upper portion 36 decreases gradually, such that the depth decreases generally linearly from the base 22 upward to the upper end 26. The intersection of the upper end 26 and the upper portion 36 occurs with an inflection line 50, extending annularly about the upper end 26. A small, horizontal ledge 52, also extending annularly about the upper end 26, is formed between the inflection line 50 and an annular finish (not shown). From this ledge 52, the annular finish extends vertically upward with threads to engage cooperating threads on an inside annular wall of the closure 32.

Referring to FIG. 2, the closure 32 includes a flip-top cover 56 fastened to the closure 32 by a plastic hinge 57. Diametrically opposed to the hinge 57, on the closure 32, is a small tab 59 which one can use to apply pressure with a finger to easily flip the cover 56 upward, pivoting it about the hinge 57, to open the container 10. Once the cover 56 is flipped open, an aperture, having a relatively small diameter of about 0.375 in. is exposed to allow the cheese sauce to be dispensed from the container 10. The aperture also receives a cooperating sleeve extending normally downward from the inside of the cover 56 to participate in a cooperating engagement with the aperture to lock the cover 56 in a closed, down, position. It is found that during heating the container and the cheese sauce, the container should be unsealed to allow moisture and the like to escape. This prevents any excessive pressure from building up in the container. Thus, either the flip-top cover 56 should be pivoted to the open position, or the closure 32 should be removed.

The container 10 is preferably constructed from a suitable polymeric material with a thickness of about 0.02 in. to 0.03 in. throughout the entire container 10. The container 10 weighs approximately 28 grams. In accordance with the ovate cross-section, it is desired that the container 10 have a predetermined constant width to depth ratio substantially over its entire height. The preferred width to depth ratio is 2:1 over substantially the entire height of the illustrated container 10 having a height dimension of about 6 in. to 7 in., a width dimension of about 3 in. to 3.5 in. and a depth dimension of about 1.25 in. to 1.75 in. Consequently, the container is designed to be filled to a level beneath the upper end 26 with about 12 ounces of viscous cheese sauce at a temperature of about 170° F. and with a density of about 1.12 g/cubic cm to 1.18 g/cubic cm and a viscosity of about 8,640 cP at 100° F. and about 3,120 cP at 140° F.

Scorching is a function of both time and temperature. In tests with a particular viscous cheese sauce containing lactic acid having about 20% to 30% cheese content, and having a density of about 1.12 g/cm$^3$ to 1.18 g/cm$^3$, scorching was observed at a temperature of about 140° F. to 160° F. after microwave oven heating for a period of about 5–6 minutes.

The 12 oz. container 10 described herein is configured to enable heating of the cheese sauce in its entirety to a desired temperature range in a relatively short period of time. For example, in a microwave oven operating with about 750 Watts of electromagnetic radiation at a frequency of about 1.45 GHz, the predetermined heating time may consist of three thirty second intervals at medium microwave power, with agitating of the container between intervals, to heat the cheese sauce to about 100° F. to 140° F., without scorching.

From the foregoing it should be appreciated that the invention provides an improved container capable of being exposed to electromagnetic radiation to facilitate uniform heating of a viscous cheese sauce from a first, storage, temperature to a second, desired, temperature. The configuration of the container provides other desirable advantageous features. Because the container is constructed of a flexible polymeric material, such as polypropylene, it is readily squeezable to decrease internal volume to force the cheese product out through an aperture of the closure 32. That is, once pressure is applied, for example, to front and back sidewalls 14 and 16, the volume of the container 10 is decreased, and the cheese sauce is forced from the container through the aperture of the closure 32. With this small aperture, it is important that the cheese does not harden into solid cheese pieces because they may interfere with the passage of cheese from the container.

The container 10 further facilitates relatively efficient use of space in transportation with the ability to be packed efficiently among like containers and provides sufficient display ability with spacious front and back wall sections on which to place marketing and product information labels. Also, the illustrated container easily fits in standard refrigerator door shelves. The container further compares favorably with conventional glass jars with respect to impact resistance.

Thus, it is apparent that there has been provided, in accordance with the invention, a container that fully satisfies the objects, aims, and advantages set forth above. While the invention has been described in conjunction with a specific embodiment, it is evident that many alternatives, modifications, and variations will be apparent to those skilled in the art in light of the foregoing descriptions.

What is claimed is:

1. A method of heating a viscous cheese sauce from a first temperature in a range of about 30° F. to 80° F. to a second temperature in a range of about 100° F. to 140° F. comprising:

providing a container made of an electrically nonconductive material having a generally horizontal, ovate bottom wall, a sidewall extending upward therefrom and an upper end portion, said sidewall having a substantially ovate cross-section over substantially its entire height, said container having a width to depth ratio of about 2:1 over substantially its entire height and having a maximum width of about 2.5 in. to 3.5 in., said sidewall having a minimum radius of curvature of about 0.35 in. as viewed in plan, and having a lower portion which increases in width proceeding upward and an upper portion which convexly decreases in width proceeding upward with a minimum radius of curvature of about 1 in. as viewed in elevation;

filling the container with the cheese sauce to a level beneath said upper end portion;

exposing the cheese sauce and container to about 100–1500 Watts of electromagnetic radiation at a frequency of between about 0.3 to 300 GHz in a microwave oven for a predetermined period of time, to increase the temperature of said cheese sauce from said first temperature to said second temperature;

whereby said cheese sauce is heated generally uniformly and is permitted to flow within said container in accordance with natural convection so as to enable said cheese sauce to be heated to said second temperature without scorching of any substantial portion thereof.

2. A method in accordance with claim 1 further comprising sealing said container with a closure at said upper end portion after said step of filling said container with cheese sauce.

3. A method in accordance with claim 2 including the step of unsealing the container before said step of exposing the cheese sauce and container in a microwave oven.

4. A method in accordance with claim 1 further comprising repeating the step of exposing the cheese sauce and container to about 100–1500 Watts of electromagnetic radiation for at least one repetition.

5. A method in accordance with claim 4 further comprising agitating the container before each repetition.

6. A method in accordance with claim 5 wherein said method includes one to three repetitions.

7. A method in accordance with claim 1 wherein the cheese sauce has a density of about 1.00 g/cm$^3$ to 1.32 g/cm$^3$.

8. A method in accordance with claim 1 wherein the cheese sauce has a scorching temperature of about 140° F. to 160° F.

* * * * *